US010210978B2

(12) United States Patent
Khoshkava et al.

(10) Patent No.: US 10,210,978 B2
(45) Date of Patent: Feb. 19, 2019

(54) HAPTIC ACTUATOR INCORPORATING CONDUCTIVE COIL AND MOVING ELEMENT WITH MAGNETS

(71) Applicant: Immersion Corporation, San Jose, CA (US)

(72) Inventors: Vahid Khoshkava, Montreal (CA); Mansoor Alghooneh, Montreal (CA); Mohammadreza Motamedi, Montreal (CA)

(73) Assignee: IMMERSION CORPORATION, San Jose, CA (US)

( * ) Notice: Subject to any disclaimer, the term of this patent is extended or adjusted under 35 U.S.C. 154(b) by 0 days.

(21) Appl. No.: 15/416,040

(22) Filed: Jan. 26, 2017

(65) Prior Publication Data

US 2018/0211751 A1 Jul. 26, 2018

(51) Int. Cl.
*H01F 7/08* (2006.01)

(52) U.S. Cl.
CPC ..... *H01F 7/081* (2013.01)

(58) Field of Classification Search
CPC ..... G06F 3/016; G06F 3/00; G06F 3/0416; G06F 3/0414; G06F 2203/04102
USPC ..... 335/230
See application file for complete search history.

(56) References Cited

U.S. PATENT DOCUMENTS 5,872,496 A * 2/1999 Asada ..... H01H 50/005 257/415
6,750,745 B1 * 6/2004 Wei ..... H01H 50/005 335/78
8,068,002 B2 * 11/2011 Shen ..... H01H 50/005 200/181
8,143,978 B2 * 3/2012 Shen ..... H01H 50/005 335/124
8,159,320 B2 * 4/2012 Ruan ..... H01H 50/005 200/181
8,493,354 B1 * 7/2013 Birnbaum ..... G06F 3/016 340/407.2
9,092,953 B1 * 7/2015 Mortimer ..... G06F 3/016
9,411,420 B2 * 8/2016 Shahoian ..... A63F 13/06
2002/0033795 A1 * 3/2002 Shahoian ..... G06F 1/1616 345/156
2012/0223880 A1 * 9/2012 Birnbaum ..... G06F 3/015 345/156

(Continued)

*Primary Examiner* — Shawki S Ismail
*Assistant Examiner* — Lisa N Homza
(74) *Attorney, Agent, or Firm* — Medler Ferro Woodhouse & Mills PLLC

(57) ABSTRACT

A haptic actuator having a base structure, a beam rotatably attached to the base structure by an axial member, a first coil portion, and a second coil portion is presented. The beam has a first end that includes a first magnet with magnetic poles having a first polarity, and a second end that includes a second magnet with magnetic poles having a second, opposite polarity. The first coil portion and the second coil portion are configured to generate magnetic field lines. The magnetic poles of the first magnet and the magnetic poles of the second magnet are aligned to be parallel with a central axis of the first coil portion or the second coil portion when the beam is in an equilibrium position. The beam is configured to rotate via the axial member in response to electrical current being passed through the first coil portion or the second coil portion.

21 Claims, 14 Drawing Sheets

(56) References Cited

U.S. PATENT DOCUMENTS

| | | | | |
|---|---|---|---|---|
| 2012/0229400 | A1* | 9/2012 | Birnbaum | G06F 3/016 345/173 |
| 2012/0229401 | A1* | 9/2012 | Birnbaum | G06F 3/016 345/173 |
| 2014/0104165 | A1* | 4/2014 | Birnbaum | G06F 3/016 345/156 |
| 2015/0109223 | A1* | 4/2015 | Kessler | G06F 3/016 345/173 |
| 2017/0060243 | A1* | 3/2017 | Khoshkava | G06F 3/016 |
| 2017/0243451 | A1* | 8/2017 | Alghooneh | G08B 6/00 |
| 2017/0269686 | A1* | 9/2017 | Khoshkava | G06F 3/016 |

* cited by examiner

HAPTIC ACTUATOR INCORPORATING CONDUCTIVE COIL AND MOVING ELEMENT WITH MAGNETS

FIELD OF THE INVENTION

The present invention is directed to a haptic actuator that incorporates a conductive coil and a moving element having magnets, and that has application in user interfaces, mobile devices, gaming, automotive, wearable devices, and consumer electronics.

BACKGROUND

As electronic user interface systems become more prevalent, the quality of the interfaces through which humans interact with these systems is becoming increasingly important. Haptic feedback, or more generally haptic effects, can improve the quality of the interfaces by providing cues to users, providing alerts of specific events, or providing realistic feedback to create greater sensory immersion within a virtual environment. Examples of haptic effects include kinesthetic haptic effects (such as active and resistive force feedback), vibrotactile haptic effects, and electrostatic friction haptic effects.

SUMMARY

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

One aspect of the embodiments herein relates to a haptic actuator that comprises a base structure, a beam rotatably attached to the base structure by an axial member, a first coil portion, and a second coil portion. The beam has a first end and a second end. The first end includes a first magnet with magnetic poles having a first polarity, and the second end includes a second magnet with magnetic poles having a second polarity opposite the first polarity. The first coil portion is attached to the base structure and is disposed at the first end of the beam and configured to generate magnetic field lines at the first end of the beam when electrical current is passed through the first coil portion. The second coil portion is attached to the base structure and is disposed at the second end of the beam and configured to generate magnetic field lines at the second end of the beam when electrical current is passed through the second coil portion. The first coil portion and the second coil portion are segments of a single conductive coil or are respective segments of separate first and second conductive coils. The magnetic poles of the first magnet at the first end and the magnetic poles of the second magnet at the second end are aligned to be parallel with a central axis of the first coil portion or the second coil portion when the beam is in an equilibrium position corresponding to zero current being passed through the first coil portion and zero current being passed through the second coil portion. The beam is configured to rotate via the axial member relative to the first coil portion and the second coil portion in response to electrical current being passed through at least one coil portion of the first coil portion and the second coil portion.

In an embodiment, the first coil portion and the second coil portion form opposite end segments of a single conductive coil that comprises a plurality of stacked turns of a conductive wire, the plurality of turns extending from a first turn to a last turn.

In an embodiment, at least a portion of the beam is located within a space between the first coil portion and the second coil portion, and between the first turn and the last turn of the conductive coil.

In an embodiment, the beam is disposed over a space defined by the first coil portion and the second coil portion, such that a gap exists between the beam and the conductive coil.

In an embodiment, the first coil portion and the second coil portion are segments of separate first and second conductive coils, respectively.

In an embodiment, the first conductive coil and the second conductive coil are disposed side-by-side such that the first end of the beam is disposed over the first conductive coil and the second end of the beam is disposed over the second conductive coil.

In an embodiment, each of the first conductive coil and the second conductive coil has a circular or elliptical shape.

In an embodiment, the first coil portion forms a concave portion relative to a remaining portion of the first conductive coil, and the second coil portion forms a concave portion relative to a remaining portion of the second conductive coil.

In an embodiment, the haptic actuator further comprises a third coil portion and a fourth coil portion. The third coil portion is configured to generate magnetic field lines parallel to the central axis at the first end of the beam when electrical current is passed through the third coil portion, where the first coil portion is stacked on the third coil portion and arranged in an electrically parallel configuration with the third coil portion. The fourth coil portion is configured to generate magnetic field lines parallel to the central axis at the second end of the beam when electrical current is passed through the fourth coil portion, where the second coil portion is stacked on the fourth coil portion and arranged in an electrically parallel configuration with the fourth coil portion.

In an embodiment, the first coil portion and the second coil portion are segments of a first conductive coil, and the third coil portion and the fourth coil portion are segments of a second conductive coil.

In an embodiment, the first coil portion, the second coil portion, the third coil portion, and the fourth coil portion are segments of a first conductive coil, a second conductive coil, a third conductive coil, and a fourth conductive coil, respectively.

In an embodiment, the first magnet comprises a first permanent magnet or a first region of magnetic particles, and the second magnet comprises a second permanent magnet or a second region of magnetic particles.

In an embodiment, the beam comprises a non-magnetized region made of a polymeric material.

In an embodiment, the axial member is attached to the base structure and attached at a rotational axis of the beam such that the beam is suspended thereby relative to the base structure.

In an embodiment, the base structure has a surface facing the beam, the surface having an opening. The beam is suspended by the axial member over the opening and is configured to rotate to a position in which one end of the beam is coplanar with the opening or traverses the opening when electrical current is passed through the conductive coil.

In an embodiment, the haptic actuator further comprises a control unit configured to pass an alternating current through the first coil portion and through the second coil portion.

In an embodiment, a total coil thickness along the central axis is in a range from 5 mm to 10 mm.

In an embodiment, the first coil portion and the second coil portion each comprise a stack of conductive layers separated by insulating layers. Each of the conductive layers has a thickness in a range between 1 micron and 5 microns. Consecutive conductive layers of the plurality of conductive layers are electrically connected to each other with a conductive via located in an insulating layer disposed therebetween.

One aspect of the embodiments herein relate to a method of manufacturing a haptic actuator. The method comprises providing base structure, forming a base structure, forming a first coil portion at a first end of the base structure, and forming a second coil portion at a second end of the base structure. The first coil portion is configured to generate magnetic field lines at the first end of the base structure when electrical current is passed through the first coil portion. The second coil is configured to generate magnetic field lines at the second end of the base structure when electrical current is passed through the second coil portion. The method further comprises attaching an axial member to the base structure, and comprises attaching a beam to the axial member such that the beam is rotatable within the base structure. The beam has: (i) a first end that includes a first magnet with magnetic poles having a first polarity and (ii) a second end that includes a second magnet with magnetic poles having a second polarity opposite the first polarity. The magnetic poles of the first magnet and the magnetic poles of the second magnet are aligned to be parallel to a central axis of at least one of the first coil portion and the second coil portion, and the beam is rotatable via the axial member relative to the first coil portion and the second coil portion.

In an embodiment, forming the first coil portion and the second coil portion comprises forming at least one conductive coil having a plurality of turns by using a sputtering process to deposit a stack of conductive layers to form the plurality of turns, where consecutive conductive layers of the plurality of conductive layers are separated by an insulating layer therebetween.

In an embodiment, forming the at least one conductive coil further comprises using a lithographic process to pattern each conductive layer into a respective loop shape.

Features, objects, and advantages of embodiments hereof will become apparent to those skilled in the art by reading the following detailed description where references will be made to the appended figures.

BRIEF DESCRIPTION OF THE DRAWINGS

The foregoing and other features and advantages of the invention will be apparent from the following description of embodiments hereof as illustrated in the accompanying drawings. The accompanying drawings, which are incorporated herein and form a part of the specification, further serve to explain the principles of the invention and to enable a person skilled in the pertinent art to make and use the invention. The drawings are not to scale.

DETAILED DESCRIPTION

Figure 1:
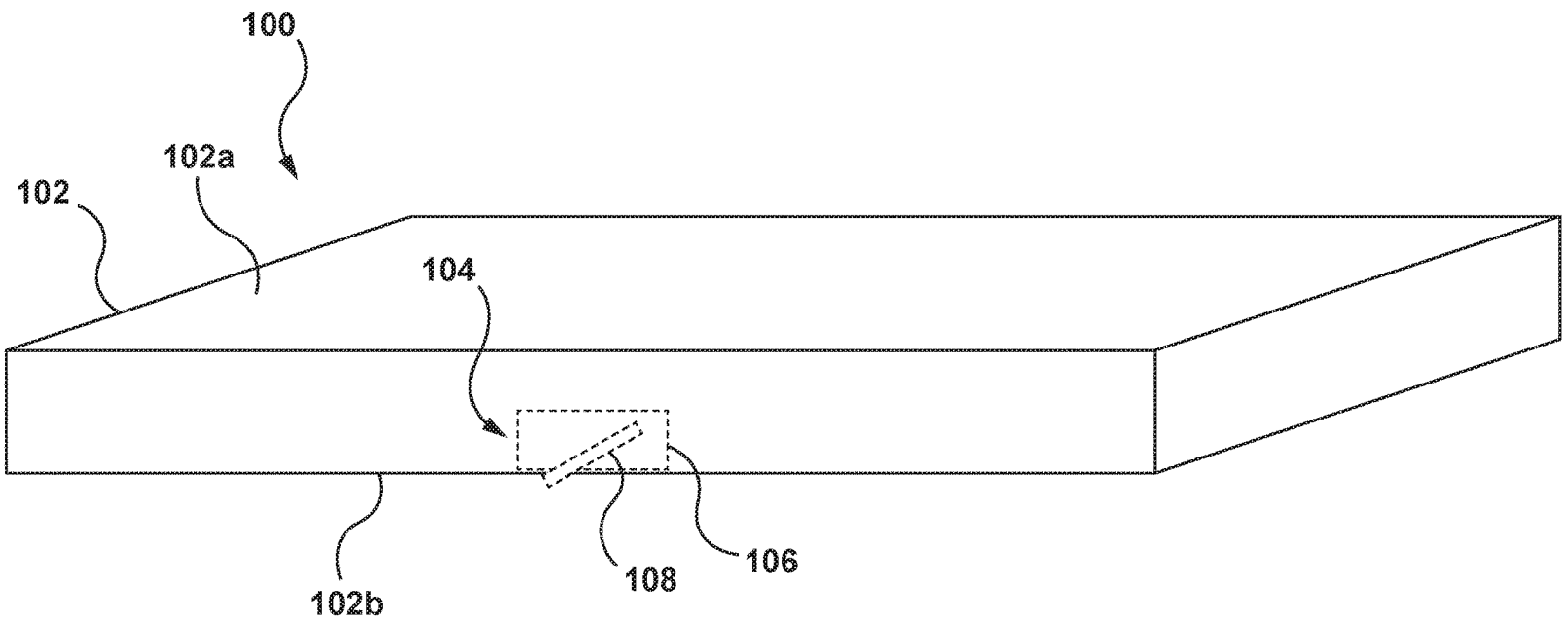
FIG. 1 is a perspective view of a haptic-enabled device having a haptic actuator that incorporates a beam as a moving element, according to an embodiment hereof.

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Embodiments hereof relate to a haptic actuator configured to provide a non-vibration or a vibration haptic effect by actuating at least one of two opposite ends of a beam with at least one conductive coil. The beam may be a moving element of the haptic actuator. The beam may have a first magnet at a first end thereof and/or a second magnet at a second end thereof. The first magnet and the second magnet may have magnetic poles that are opposite in polarity. The at least one conductive coil may be configured to generate (e.g., induce) magnetic field lines of a magnetic field, which interacts with the first magnet and/or the second magnet to actuate the beam. A first coil portion (e.g., a first portion of a conductive coil) may be configured to generate a magnetic field to, e.g., attract the first magnet at the first end of the beam, while a second coil portion (e.g., a second portion of the conductive coil) may be configured to generate a magnetic field to, e.g., repel the second magnet at the second end of the beam. The beam may be rotatably attached to a base structure, so that the actuating forces on the first end and/or second end of the beam create a torque that rotates the beam.

In an embodiment, the rotation of the beam may be used to create a haptic effect, by, e.g., tapping the beam against a user's skin or some other surface. In an embodiment, the direction of rotation may be switched back and forth with a low frequency or a high frequency, so as to provide a haptic actuator that has a low frequency mode and a high frequency mode, respectively. The low frequency mode may provide, e.g., a tapping sensation to be felt by a user. The high frequency mode may provide, e.g., a vibrotactile sensation to be felt by the user. Thus, the haptic actuator described herein may be an electromagnetic actuator designed to provide non-vibration or vibration haptic feedback.

In an embodiment, the haptic actuator may be designed to have a thin profile for incorporation into a wearable device (e.g., a smart watch, augmented reality device, or virtual reality head-mounted device), a game console controller, a mobile phone, or any other user interface device. In an embodiment, the conductive coil may be formed by winding a conductive wire into multiple stacked turns. In an embodiment, thin film technology may be used to make a conductive coil with a thin profile. In this embodiment, conductive material may be deposited directly onto a base structure of the actuator to form the conductive coil. This deposition process may deposit multiple conductive layers to form respective turns of the conductive coil, with an insulating layer deposited between consecutive conductive layers.

In an embodiment, the haptic actuator may have multiple conductive coils that are arranged to reduce magnetic field leakage. The magnetic field leakage may refer to the generation of magnetic field lines which are not used to actuate the beam or perform other mechanical work on the beam. This may occur, for example, when a portion of the coil is located relatively far away from magnetic regions of the beam. The magnetic field lines generated by this portion of the coil may thus have reduced interaction with the beam, and have little effect on actuation of the beam. Thus, while power may be expended to pass electrical current through this portion of the coil, the magnetic field generated by this portion of the coil may be considered to be leaked because it contributes little to actuation of the beam.

In an embodiment, the magnetic field leakage may be reduced by, e.g., providing a first conductive coil that is local to a first magnet at the first end of the beam and providing a second conductive coil that is local to a second magnet at the second end of the beam, and reducing or eliminating the presence of other coil portions at regions that are not local or adjacent to the first and second magnets of the beam. In this configuration, the magnetic field lines generated by the first coil and the second coil are local or adjacent to the first magnet at the first end of the beam and to the second magnet at the second end of the beam, respectively. Further, because the presence of coil portions at regions that are not local to the first magnet and the second magnet is reduced or eliminated, magnetic field leakage is reduced. In an embodiment, each of the first conductive coil and the second conductive coil may have a concave portion that forms a C shape. In an embodiment, the first conductive coil and the second conductive coil may be two circular-shaped or elliptical-shaped coils that are placed side-by-side, such that they are laterally disposed next to each other, with the two coils extending along two respective central axes that are parallel and separated by a distance.

FIG. 1 illustrates a perspective view of a haptic-enabled device 100 (e.g., a smart phone or tablet computer) that has a haptic actuator 104. The haptic-enabled device 100 has a housing 102 that has a front surface 102*a* and a rear surface 102*b*. The haptic actuator 104 may include a base structure 106 and a beam 108 rotatably attached to the base structure 106. The base structure 106 may, for instance, act as a frame or platform on which the beam 108 is suspended via an axial member, so that the beam 108 can rotate relative to the frame. The beam 108 may be made of, e.g., a metal (e.g., ferromagnetic metal) or a combination of a metal and a polymeric material (e.g., plastic).

In an embodiment, the housing 102 of the haptic-enabled device 100 may have an opening in its front surface 102*a* or rear surface 102*b* that exposes the haptic actuator 104, and more specifically the beam 108, to an external object such as a user's hand, wrist, or other body part. For example, as a user holds the haptic-enabled device 100 with his or her hand, the palm of his or her hand may be in contact with rear surface 102*b* of the housing 102 of the haptic-enabled device 100. In this embodiment, the housing 102 of the haptic-enabled device 100 may expose the beam 108 to the palm of the user's hand. When the beam 108 is actuated, it may be actuated to a position at which it contacts the user's palm. The beam may be rotated in alternating directions so that a first end of the beam and a second end of the beam alternate with each other in being in contact with the user's palm. If frequency at which the rotation is alternated is low, the beam may impart a tapping sensation to the user. If the frequency at which the rotation is alternated is high, the beam may impart a vibrotactile sensation to the user.

In an embodiment, the rear surface 102*b* of the housing 102 may completely cover the haptic actuator 104. In this embodiment, the beam 108 of the haptic actuator 104 may be sufficiently long such that it can be rotated to tap the rear surface 102*b* of the housing. In this embodiment, a first end of the beam 108 may be rotated to contact an inner side of the rear surface 102*b*. In an embodiment, the rear surface 102*b* may have an opening which exposes the haptic actuator 104 to an outside environment, as described above, such that the beam 108 can be rotated to tap an object outside of the housing 102. In either embodiment, the direction of rotation of the beam may be periodically reversed. The periodic reversal of the direction of rotation may be done at a high frequency, to create, for example, a vibrotactile haptic effect, or at a lower frequency to create a more generally tapping haptic effect.

Figure 2A:
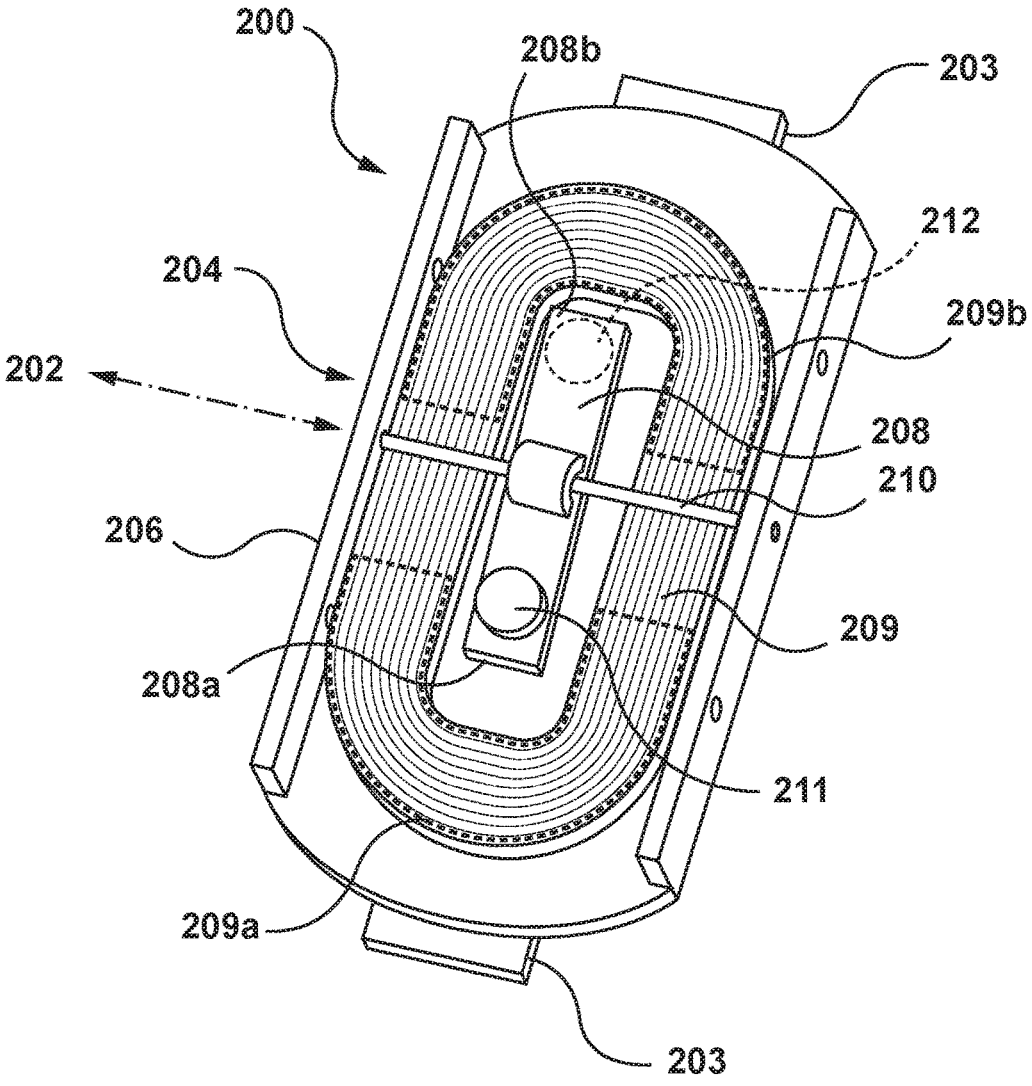
FIGS. 2A and 2B are perspective views of a wearable haptic-enabled device having a haptic actuator that incorporates a base structure, a conductive coil and a beam as a moving element, according to an embodiment hereof.
Figure 2B:
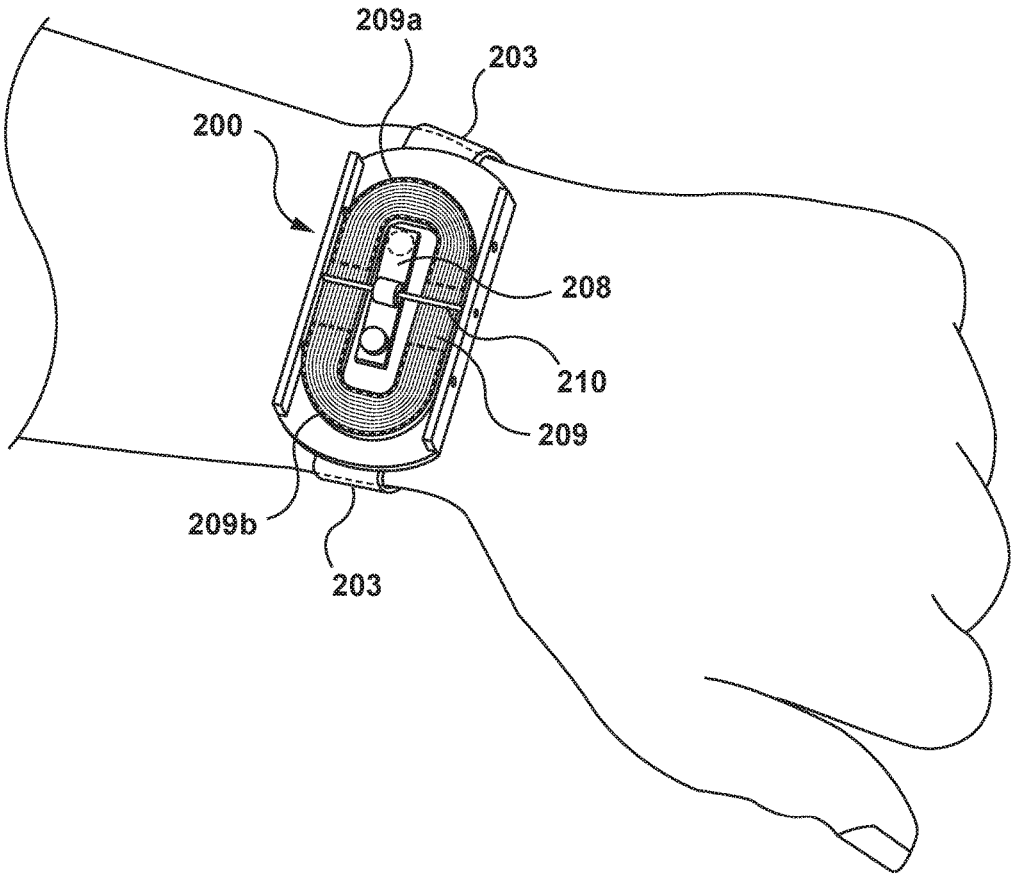

FIG. 2A illustrates a perspective view of a wearable haptic-enabled device 200 (e.g., activity tracker or smart watch) that includes a haptic actuator 204. In an embodiment, the wearable haptic-enabled device 200 may include a wrist strap 203 that allows the wearable haptic-enabled device 200 to be worn on a wrist of a user, as shown in FIG. 2B. The haptic actuator 204 of the device 200 may include a base structure 206 to which components of the haptic actuator 204 are directly or indirectly attached. The haptic-enabled device 200 may further include a housing which houses the haptic actuator 204 and other components of the device 200. In an embodiment, the base structure 206 may form a portion (e.g., side portions and a lower portion) of the housing of device 200. In this embodiment, the base structure 206 (and thus the housing of device 200) may have an opening which exposes a user's wrist or other body part to components of the haptic actuator 204. In another embodiment, the base structure 206 and the housing of the device 200 may have a surface which completely physically separates the user from the components of the haptic actuator 204.

In an embodiment, the haptic actuator 204 includes the base structure 206, an axial member 210 (e.g., a thin rod) attached to the base structure 206 and forming a rotational axis 202, a beam 208 rotatably attached at the rotational axis 202 to the base structure 206 via the axial member 210, and a conductive coil 209 attached to the base structure 206. The beam 208 may serve as a moving element for the actuator 204, and may have a first end 208*a* and a second end 208*b*, where the first end 208*a* and the second end 208*b* are opposite ends of the beam 208. The first end 208*a* may have a first magnet 211, and the second end 208*b* may have a second magnet 212. In an embodiment, the first magnet 211 may magnetize the first end 208*a* of the beam 208 along its thickness to have a first polarity, and the second magnet 212 may magnetize the second end 208*b* of the beam 208 along its thickness to have a second, opposite polarity.

In an embodiment, one segment (e.g., a left segment relative to a user) of the conductive coil 209 may be designated a first coil portion 209*a*, and another segment (e.g., a right segment relative to a user) of the conductive coil 209 may be designated a second coil portion 209*b*. The first coil portion 209*a* may be disposed at the first end 208*a* of the beam, and may be configured to generate magnetic field lines at the first end 208*a* (e.g., magnetic field lines that extend to the first end) when electrical current is passed through the conductive coil 209. The second coil portion 209*b* may be disposed at the second end 208*b* of the beam, and may be configured to generate magnetic field lines at the second end 208*b* of the beam when the electrical current is passed through the coil 209. The magnetic field lines generated by the coil portions 209*a*, 209*b* may interact with the first magnet 211 and the second magnet 212 to rotate the beam 208 relative to the first coil portion 209*a* and the second coil portion 209*b*. FIG. 2B illustrates the haptic-enabled device 200 being attached to the user's wrist via a strap 203. In an embodiment, the coil 209, axial member 210, and the beam 208 may be hidden by an outer cover of a housing of the haptic-enabled device 200, and FIG. 2B may be illustrating a view in which at least part of the outer cover of the housing has been removed.

Figure 3:
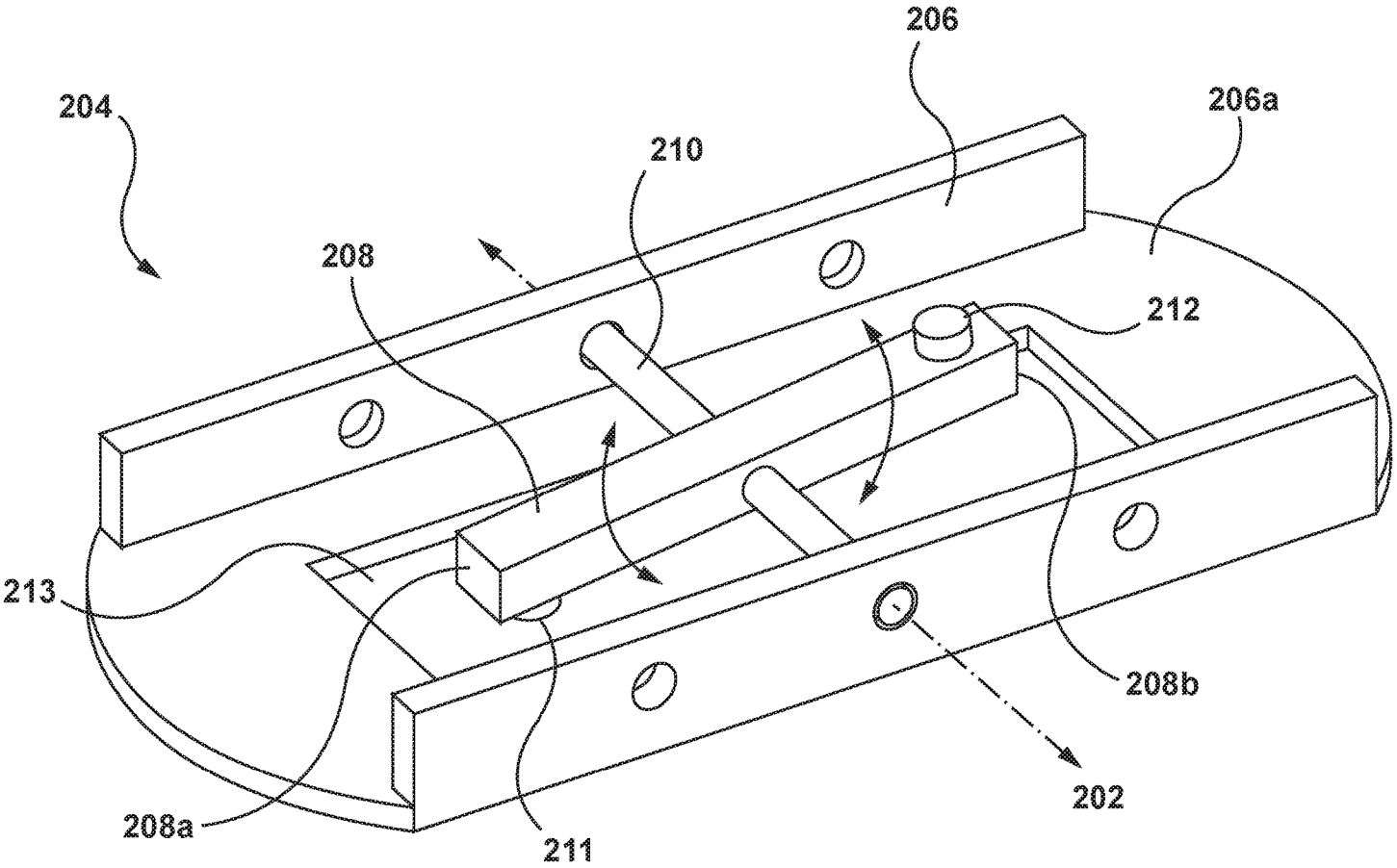
FIG. 3 is a perspective view of a base structure and a beam of a haptic actuator, according to an embodiment hereof.

FIG. 3 illustrates the base structure 206, axial member 210, and beam 208 of the haptic actuator 204 with the coil 209 removed for illustrative purposes. In an embodiment, the base structure 206 may be a platform or frame on which the beam 208 is suspended via axial member 210 to be rotatable relative thereto. In an embodiment, the base structure 206 may have a surface 206*a* on which the conductive coil 209 of FIGS. 2A and 2B can be placed, and which faces the beam 208. In an embodiment, the surface 206*a* of the base structure 206 may have an opening 213 (as shown in FIG. 3) that expose the beam 208 to an environment outside of the haptic actuator 204, which may also be an environment outside of the haptic-enabled device 200 of FIGS. 2A and 2B. This opening 213 in surface 206*a* allows the beam 208 to rotate to a position that is coplanar with or traverses the opening (depending on the beam length) to contact objects in the external environment, such as a user's wrist, to impart a haptic sensation thereon. In an alternative embodiment, the surface 206*a* has no opening under the beam 208.

In an embodiment, as mentioned above, the beam 208 may be attached to the base structure 206 via the axial member 210. More specifically, the beam 208 may be attached to the axial member 210 (e.g., by an adhesive, or by inserting the axial member 210 through a hole in the beam 208), and the axial member 210 may be attached to the base structure 206. The attachment may allow the beam 208 to rotate relative to the base structure 206. The beam 208 may be rotatable relative to the axial member 210, or the beam may be fixedly attached to the axial member 210 and the axial member 210 may be rotatable relative to the base structure 206. In either embodiment, the rotatable connections may be configured to provide low friction between the parts to provide for smooth rotation.

In an embodiment, as mentioned above, the beam 208 may be actuated with the use of the first magnet 211 disposed at the first end 208*a* of the beam 208, and the second magnet 212 disposed at the second end 208*b* of the beam 208, where the first end 208*a* is opposite the second end 208*b*. The first magnet 211 has magnetic poles having a first polarity, and the second magnet 212 has magnetic poles having a second polarity opposite the first polarity. As illustrated in FIG. 3, the first magnet 211 may be a permanent magnet attached to a lower side of the first end 208*a*, and the second magnet 212 may be another permanent magnet attached to an upper side of the second end 208*b*. In another embodiment, the first magnet 211 and the second magnet 212 may be embedded within the beam 208. For instance, the beam 208 may comprise plastic material, and the first magnet 211 and second magnet 212 may be disposed within a cavity inside the plastic material of the beam 208. In another example of this embodiment, the beam 208 may be made of a ferromagnetic material, and the first magnet 211 may comprise nanomagnetic particles having the first polarity, and the second magnet 212 may comprise nanomagnetic particles having the second polarity. The nanomagnetic particles may be disposed on or within the respective portions of the beam 208 using, e.g., a thin film technique.

Figure 4A:
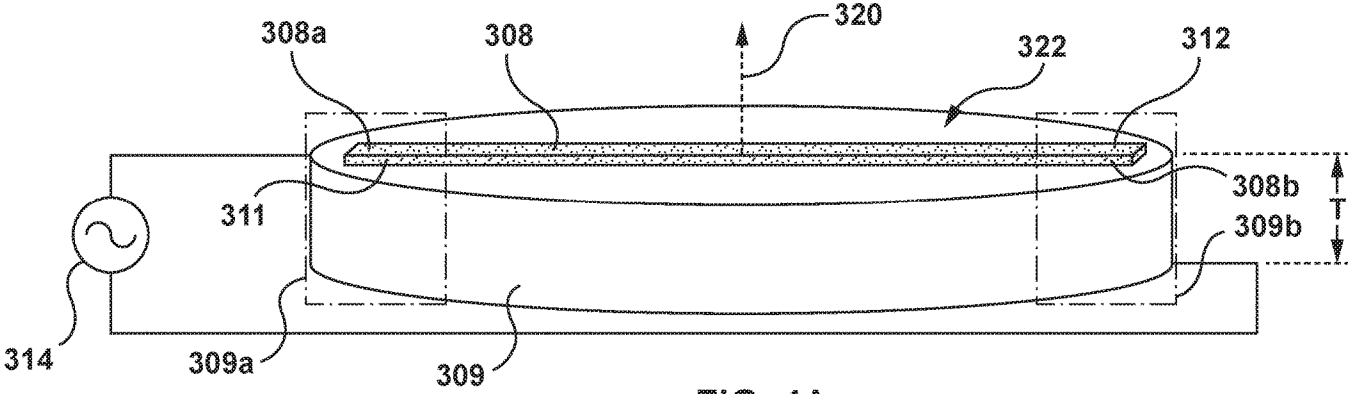
FIGS. 4A-4C are respective perspective, side, and top views of a conductive coil and beam of a haptic actuator, according to an embodiment hereof.
Figure 4B:
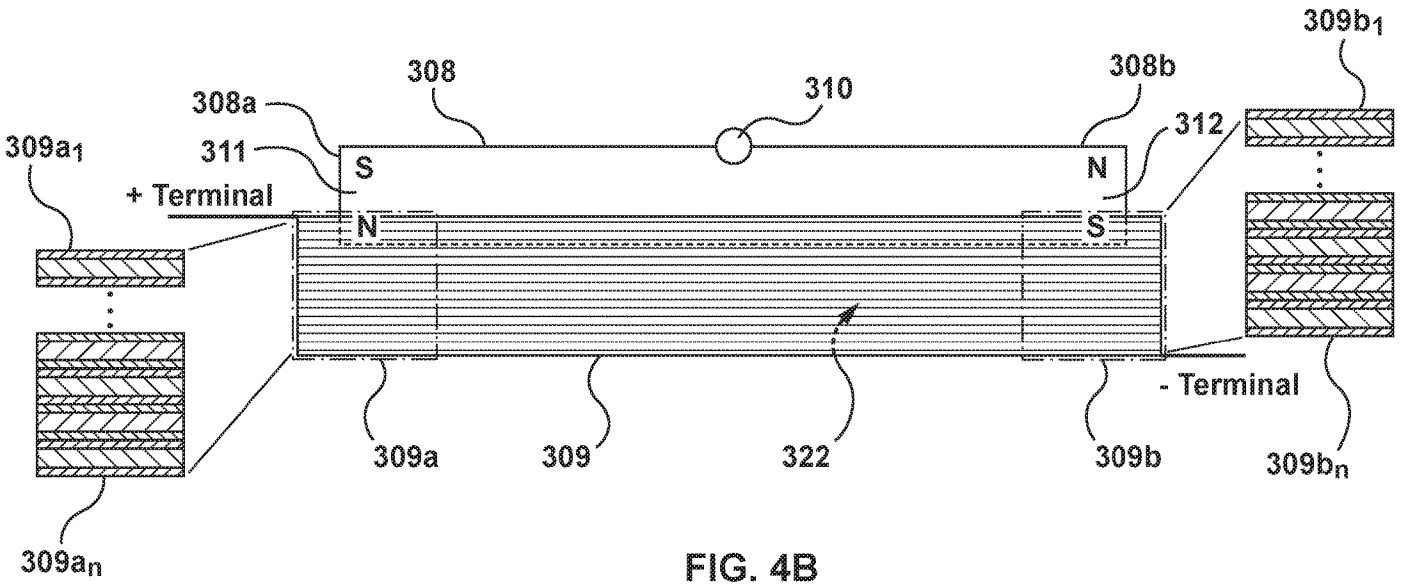
Figure 4C:
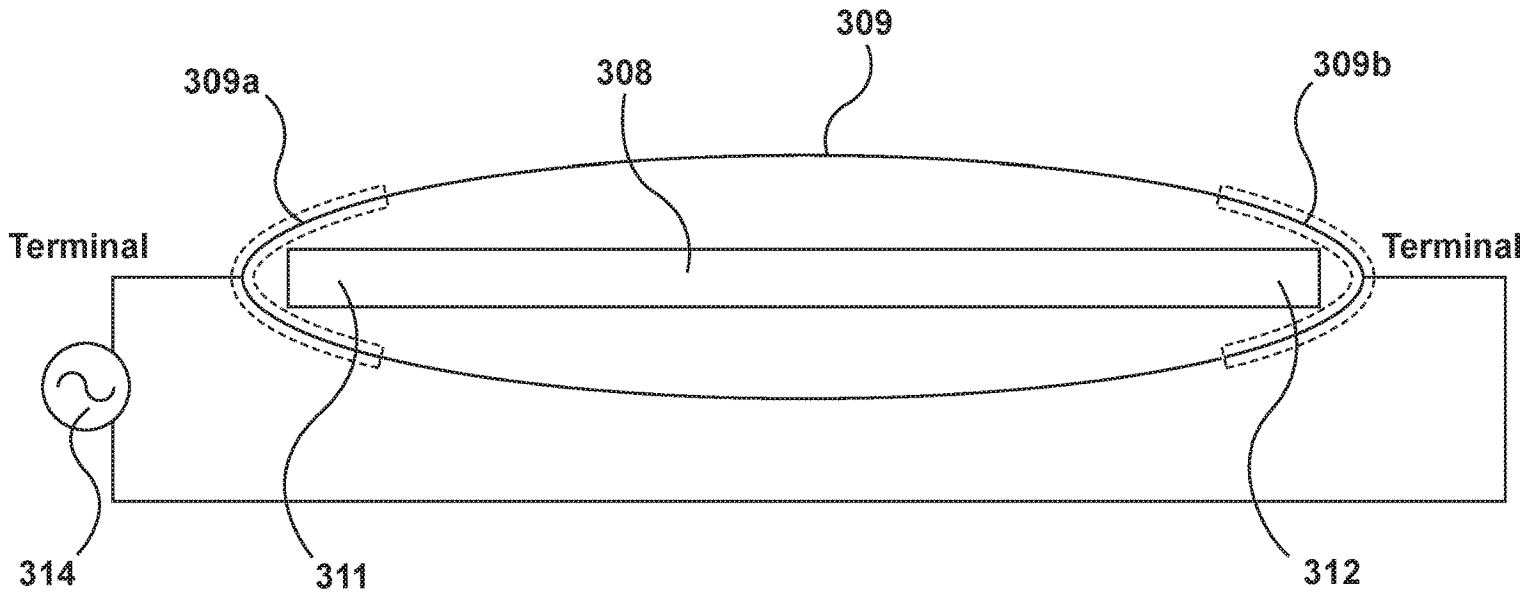

FIGS. 4A-4C illustrate a perspective, side, and top view, respectively, of a beam 308 that is rotatable via an axial member 310 through the use of embedded first and second magnets 311, 312 at respective first and second ends 308*a*, 308*b* of the beam, and through the use of at least one conductive coil 309. More specifically, FIG. 4A depicts a conductive coil 309, such as a coil of copper wire having a plurality of stacked turns that spiral along a central axis 320. In an embodiment, the conductive coil 309 may be disposed on a base structure of a haptic actuator, such as the base structure 206 in FIG. 3. Returning to FIG. 4A, the coil 309 may have a first coil portion 309*a* and a second coil portion 309*b*. The first coil portion 309*a* and the second coil portion 309*b* may each also comprise a portion of a plurality of stacked turns of the copper wire or other material making up the coil 309. In FIG. 4B, a sectional view of a portion of the first turn through the last turn of the first coil portion 309*a* is labeled as 309$a_1$ through 309$a_n$, and a sectional view of a portion of the first turn through the last turn of the second coil portion 309*b* is labeled as 309$b_1$ through 309$b_n$. Each turn may comprise, e.g., a solid copper core surrounded by an insulating coating. As depicted in FIGS. 4A-4C, the first coil portion 309*a* and the second coil portion 309*b* are disposed at opposite end segments of the same conductive coil 209, such that electric current which passes through the first coil portion 309*a* also passes through the second coil portion 309*b*. Accordingly, the portion of turns 309$a_1$-309$a_n$ and the portion of respective turns 309$b_1$-309$b_n$ in FIG. 4B may be corresponding segments of the same respective turns of the conductive coil 309. For instance, turn 309$a_1$ and turn 309$b_1$ may both be part of a first turn of the conductive coil 309, turn 309$a_2$ and turn 309$b_2$ may both be part of a second turn of the conductive coil 309, etc.

In an embodiment, the central axis 320 may be a longitudinally-extending axis along which a thickness (depth) of the conductive coil 309 extends, from the first (or bottom) turn to the last (or top) turn of the conductive coil. In an embodiment, a total thickness T of the conductive coil 309 along the central axis 320 is in a range from 5 mm to 10 mm.

In an embodiment, the first coil portion 309*a* is a segment of the conductive coil 309 that is disposed at a first end 308*a* of the beam 308, and the second coil portion 309*b* is a segment of the conductive coil 309 that is disposed at a second end 308*b* of the beam 308, as shown in FIGS. 4A-4C. FIG. 4B further depicts the first magnet 311 with magnetic poles having a first polarity, and a second magnet 312 with magnetic poles having a second polarity opposite the first polarity. The beam 308 may be disposed completely or partially within, or disposed over, a cylinder-shaped space 322 that is between the first coil portion 309*a* and the second coil portion 309*b*, and between a first turn (309$a_1$ or 309$b_1$) of the coil 309 and a last turn (309$a_n$ or 309$b_n$) of the coil 309. In FIG. 4B, a lower portion of the beam 308 is disposed within (i.e., inside) the space 322. As shown later in the disclosure (see FIG. 7), a beam may be disposed completely over this space. In an embodiment, disposing the beam 308 partially or completely within the space 322 may bring it closer to magnetic field lines which are generated by the coil and which are parallel to the central axis 320. As a result, the interaction with the magnets 311, 312 and the torque generated therefrom may be stronger in this configuration.

FIGS. 4A and 4C further illustrate a power source 314 that is configured to apply an electrical current to the conductive coil 309. The power source 314 may be a component (e.g., signal generating circuit) of a haptic actuator and attached to the base structure 206 in FIGS. 2A and 2B, or may be separate from the haptic actuator. The power source 314 may have a positive and negative terminal which are connected to a start of the coil 309's first turn (e.g., 309$a_1$) and to an end of the coil 309's last turn (e.g., 309$b_n$), respectively.

Figure 5:
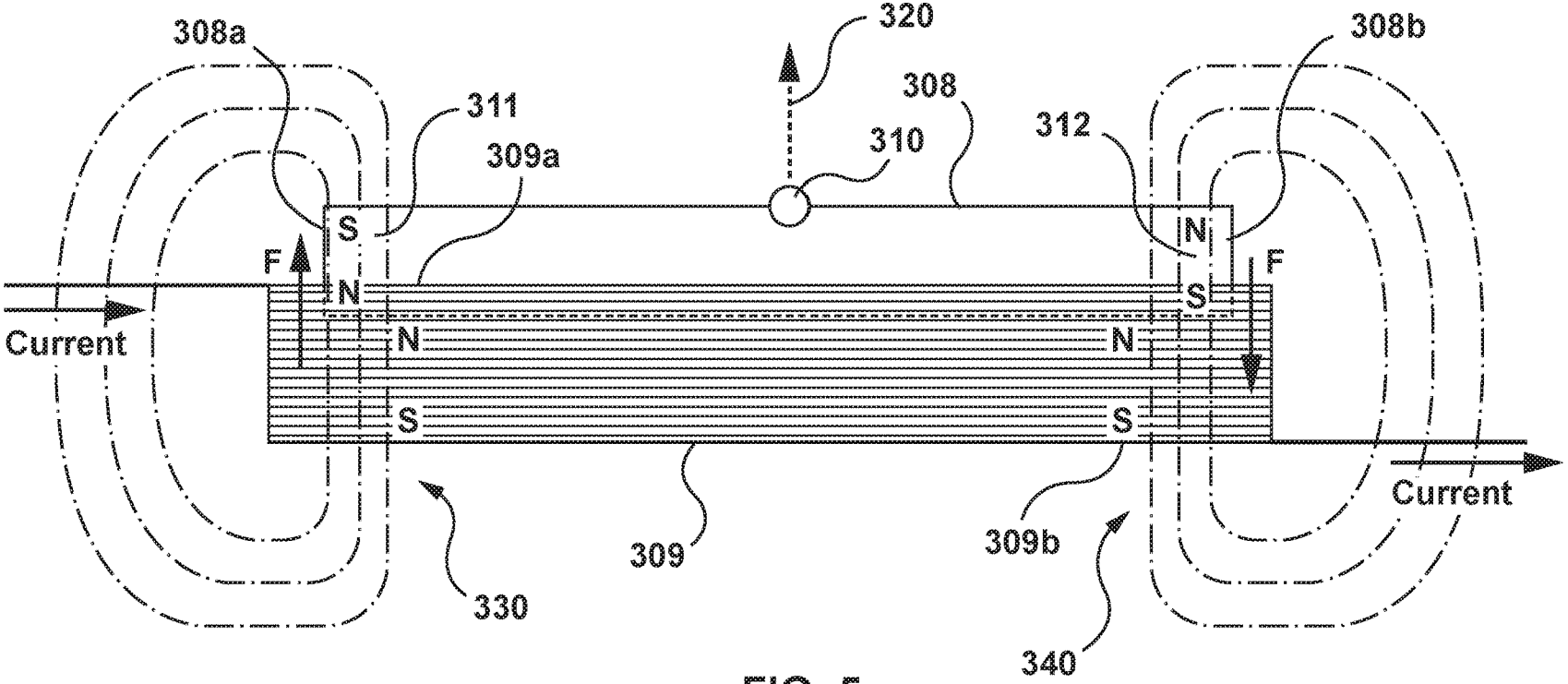
FIG. 5 depicts magnetic field lines generated by a conductive coil, according to an embodiment hereof.

FIG. 5 depicts magnetic field lines which are generated by the conductive coil 309 when electrical current is passed therethrough at a time $t_0$. Magnetic field lines may be generated all along the conductive coil 309 to form magnetic field lines that loop around, or encircle, the coil 309. FIG. 5 depicts only the magnetic field lines 330, 340 generated from the first coil portion 309*a* and the second coil portion 309*b*. The magnetic field lines from other portions of the coil 309 (not shown) may be farther from the beam 308 and have weaker interaction with the beam 308, and thus constitute magnetic leakage, as discussed below. In FIG. 5, the magnetic field lines 330, 340 generated by the first portion 309*a* and the second portion 309*b* may be parallel to the central axis 320 of the conductive coil 309, and normal/perpendicular to a coil plane (e.g., a plane of an ellipse enclosed by the coil 309) of the coil 309. Thus, FIG. 5 illustrates that the first coil portion 309*a* may be configured to generate magnetic field lines 330 at the first end 308*a* that are parallel to the central axis 320, and the second coil portion 309*b* may be configured to generate magnetic field lines 340 at the second end 308*b* that are parallel to the central axis 320. More specifically, in the embodiment of FIG. 5, the portion of the magnetic field lines 330, 340 that are inside the conductive coil 309 or otherwise within a concave side of the coil 309 are parallel to the central axis 320. The portion of the magnetic field lines 330, 340 that are outside the conductive coil 309 or otherwise on a convex side of the coil 309 may also be substantially parallel to the central axis, but that portion may have less importance because it does not interact with the magnets of the beam 308.

As shown in FIG. 5, the magnetic field lines generated by the conductive coil 309 may exert actuating forces on the first magnet 311 at the first end 308*a* of the beam and the second magnet 312 at the second end 308*b* of the beam. For instance, the magnetic field lines from the first coil portion 309*a* may have a north pole that faces a north pole of the first magnet 311. As a result, the magnetic field lines generated by the first coil portion 309*a* may repel the first magnet 311, and exert a pushing force on the first end 308*a* of the beam 308. The magnetic field lines generated by the second coil portion 309*b* may have a north pole that faces a south pole of the second magnet 312. As a result, the magnetic field lines generated by the second coil portion 309*b* may attract the second magnet 312, and exert a pulling force on the second end 308*b* of the beam 308. These forces acting in opposite directions on respective ends of the beam may generate a torque on the beam 308 that causes it to rotate about the axial member 310 in a clockwise direction.

Figure 6A:
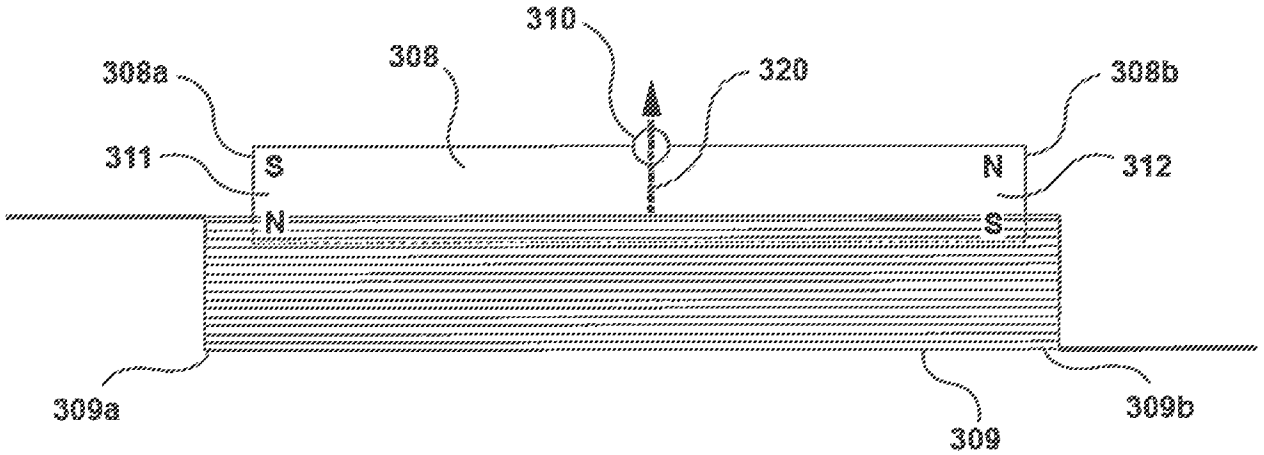
FIGS. 6A-6C depict rotation of a beam of a haptic actuator, according to an embodiment hereof.
Figure 6B:
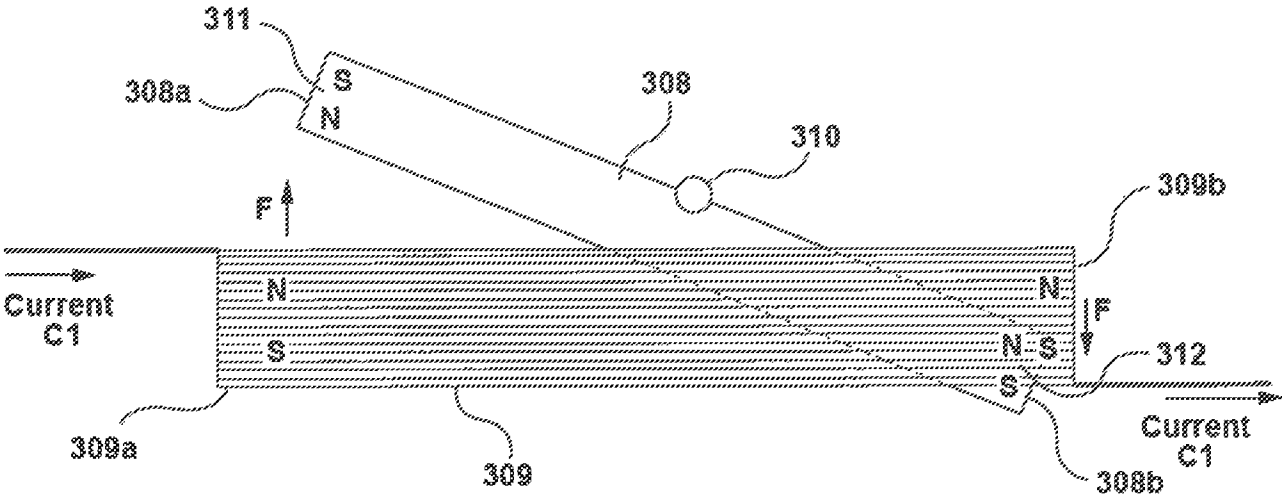
Figure 6C:
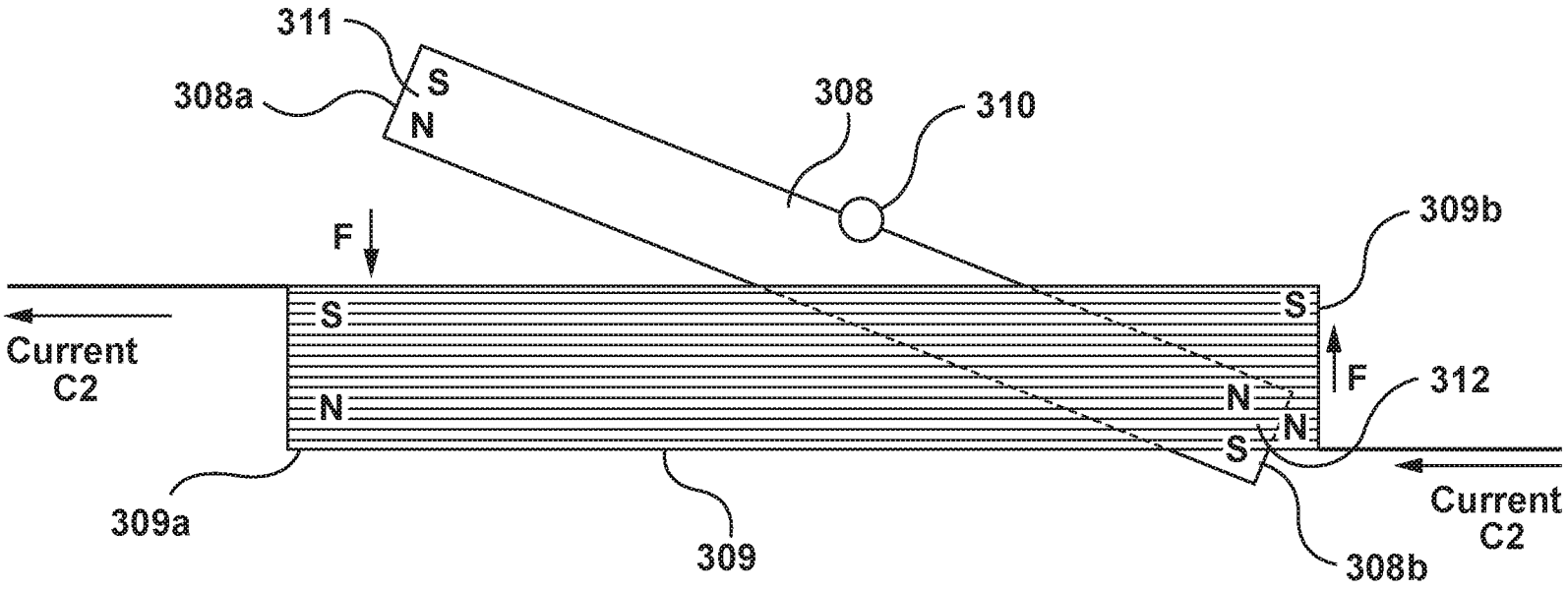

In an embodiment, a direction of beam rotation may be changed by reversing the direction of the electrical current applied to (running through) the conductive coil 309, as illustrated in FIGS. 6A-6C. FIG. 6A depicts a state in which the beam 308 is in an equilibrium position corresponding to zero current being passed through the first coil portion 309*a* and zero current being passed through the second coil portion 309*b* (e.g., at a time right before $t_0$). In the equilibrium position, the magnetic poles of the first magnet 311 at the first end 308*a* and the magnetic poles of the second magnet 312 at the second end 308*b* may be aligned to be parallel with the central axis 320. When an electrical current C1 is applied to the conductive coil 309 at time $t_0$ to generate a magnetic field, as shown in FIG. 5, the beam 308 experiences a torque that causes it to rotate away from the equilibrium position. FIG. 6B depicts the beam 308 at a time $t_1$, after a time period in which the current has been continued to be applied to the first coil portion 309*a* and the second coil portion 309*b*. At time $t_1$, the beam 308 may be rotated to a position at which, e.g., the second end 308*b* of the beam taps or otherwise makes contact with an object (e.g., wrist) external to a haptic actuator (e.g., haptic actuator 204 of FIG. 2B). In this position, the magnetic poles of the first magnet 311 and the second magnet 312 may no longer be parallel with the central axis 320 of the coil 309. Further, the amount of force exerted by the magnetic field lines of the conductive coil 309 on the magnets at the first end 308*a* and the second end 308*b* may be smaller compared to that in FIG. 5, because of, e.g., an increased distance between the repelling poles of portion 309*a* and magnet 311, and/or an increased distance between the attracting poles of portion 309*b* and magnet 312.

FIG. 6C depicts an electrical current C2 that has a reverse direction from electrical current C1, such as right after time $t_1$. In FIG. 6C, the magnetic field lines generated by the first coil portion 309*a* and second coil portion 309*b* may also reverse in direction, causing a polarity of their magnetic poles at those segments to also reverse in direction. As a result, the magnetic field lines generated by the first coil portion 309*a* may attract the first magnet 311 in a downward direction, while the magnetic field lines generated by the second coil portion 309*b* may repel the second magnet 312 in an upward direction. These forces acting in opposite directions on respective ends of the beam may create a torque on the beam 308 that rotate the beam 308 in a counterclockwise direction.

In an embodiment, electrical current may be applied as an alternating current (AC) signal (e.g., a sinusoidal wave or square wave) to change direction of the electrical current with a regular period. The beam 308 may then rotate back and forth, between a clockwise and a counterclockwise direction, at a rate that substantially matches a frequency of the AC signal. In an embodiment, the frequency of the AC signal is in a range from 1 Hz to 200 Hz.

Figure 7:
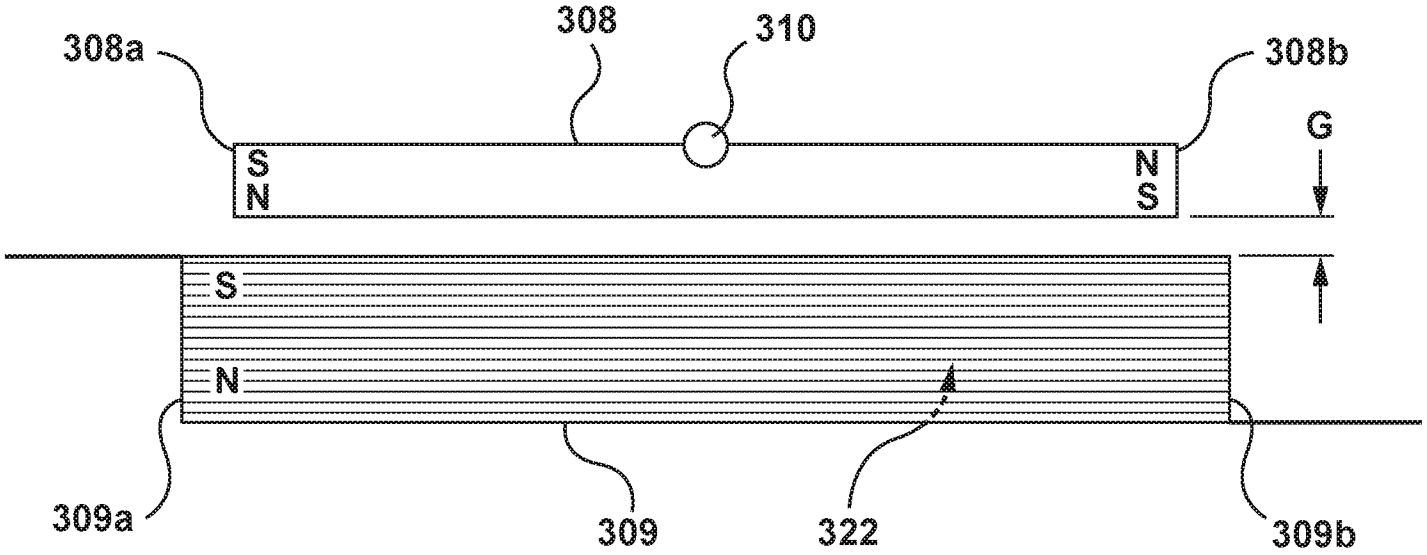
FIG. 7 depicts a beam being disposed completely above a space that is between a first turn and a last turn of a conductive coil, according to an embodiment hereof.

FIG. 7 illustrates an embodiment in which the beam 308 is disposed over a space 322 that is between the first coil portion 309*a* and the second coil portion 309*b*, and between the first turn and the last turn of the conductive coil 309. This arrangement leaves a gap G between, e.g., a bottom side of the beam 308 and a first (or top) turn of the conductive coil 309. In an embodiment, the gap may be in a range from 1 mm to 10 mm.

Figure 8A:
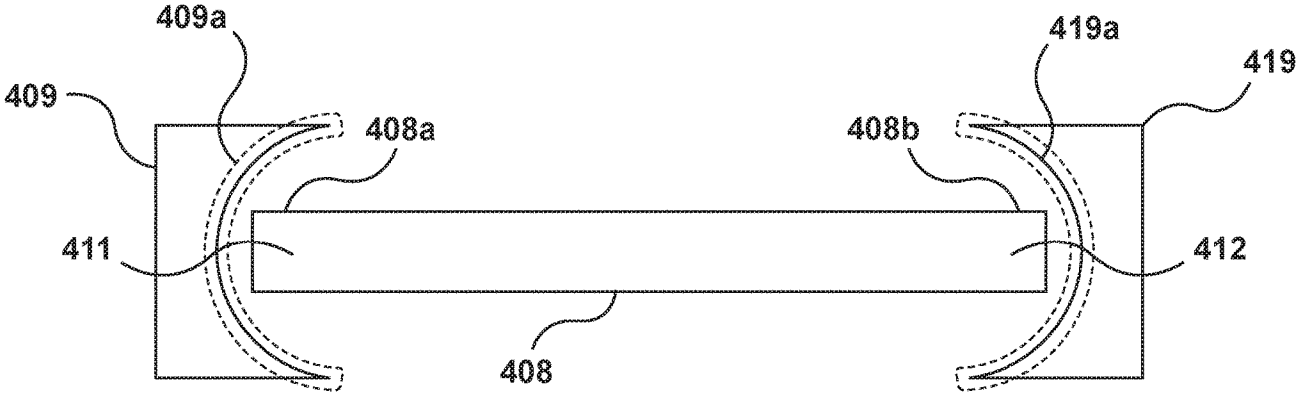
FIGS. 8A and 8B depict conductive coils having a concave shape, according to an embodiment hereof.
Figure 8B:
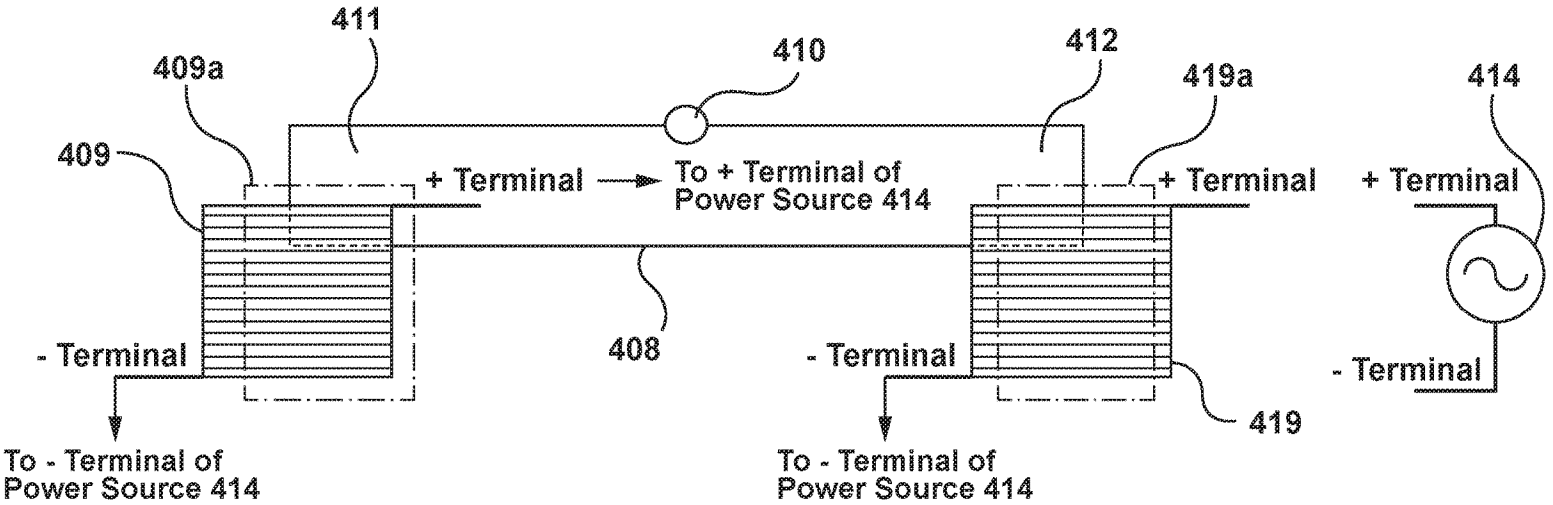

In an embodiment, magnetic field leakage may occur for a conductive coil, such as coil 309 in FIGS. 4A-4C, because the electrical current applied to the conductive coil expends energy generating magnetic field lines at segments where the magnetic field lines have reduced interaction with the beam 308, compared to the magnetic field lines at the first coil portion 309*a* and second coil portion 309*b*. These segments that connect and extend between the first coil portion 309*a* and the second coil portion 309*b* may thus be considered to exhibit magnetic field leakage. In an embodiment, these segments may be eliminated by using at least two separate conductive coils, rather than a single circular or elliptical conductive coil 309. For instance, FIGS. 8A-8B illustrate an embodiment in which a first coil portion 409*a* is a segment of a first conductive coil 409, and in which a second coil portion 419*a* is a segment of a second conductive coil 419. Because in this embodiment the first coil portion 409*a* and the second coil portion 419*a* are respective segments of two different conductive coils, there is no need to connect first coil portion 409*a* and the second coil portion 419*a* with another segment of conductive coil. By removing the need for this connecting segment, magnetic field leakage from such a connecting segment may also be removed.

In FIG. 8A, the first coil portion 409*a* may be a C-shaped segment of the first conductive coil 409 in which the coil 409 curves around a first end 408*a* of the beam 408. The second coil portion 409*b* may be a C-shaped segment (e.g., a backward C shape) of the second conductive coil 419 in which the coil 419 curves around a second end 408*b* of the beam 408. Stated another way, the coil portion 409*a* may be described to form a concave portion relative to a remaining portion of the conductive coil 409, and the coil portion 419*a* may be described to form a concave portion relative to a remaining portion of the conductive coil 419.

In an embodiment, electrical current which is applied to the first conductive coil 409 and the second conductive coil 419 may come from the same power source (e.g., power source 414), as depicted in FIG. 8B, or from respective different power sources.

In an embodiment, the first coil portion 409*a* may be configured to generate magnetic field lines at the first end 408*a* of the beam 408. The magnetic field lines at the first end 408*a* may interact with a first magnet 411 at the first end 408*a*, to generate a force which, e.g., repels the first magnet 411. The second coil portion 419*a* may be configured to generate magnetic field lines at the second end 408*b* of the beam. The magnetic field lines at the second end 408*b* may interact with a second magnet 412 at the second end 408*b* to generate a force which, e.g., attracts the second magnet 412. Thus, the two separate conductive coils 409, 419 are also able to generate forces on the respective first end 408*a* and the second end 408*b* of the beam 408, which may cause the beam 408 to rotate about an axial member 410.

Figure 9A:
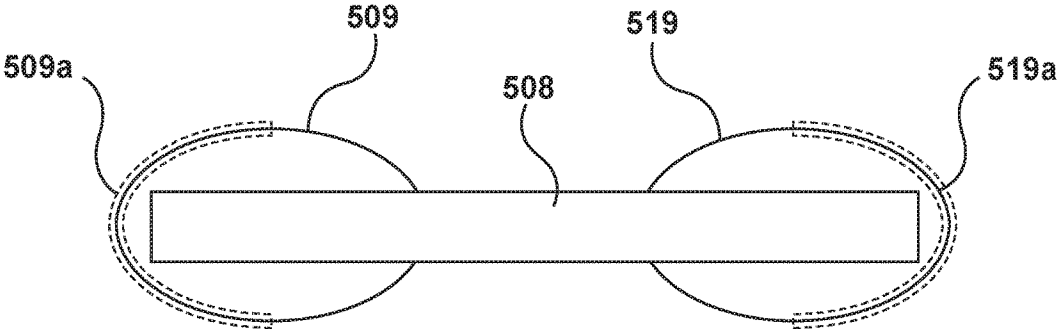
FIGS. 9A and 9B depict conductive coils which are arranged side-by-side, according to an embodiment hereof.
Figure 9B:
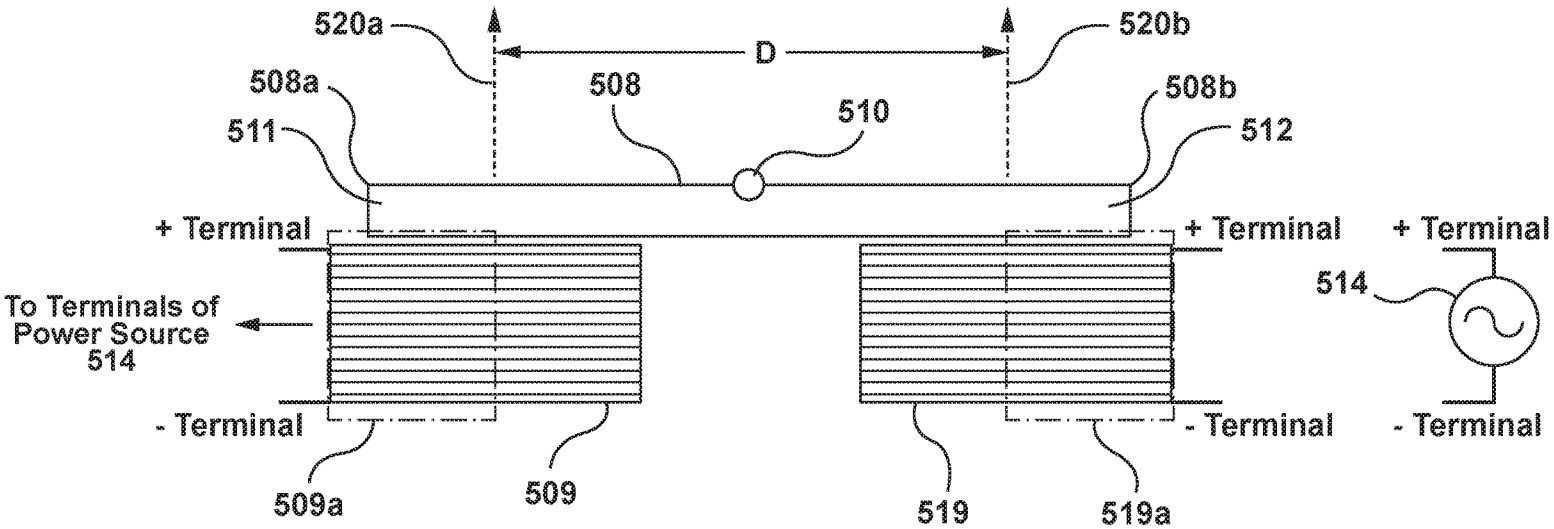

In a similar manner to the embodiment of FIGS. 8A-8B, FIGS. 9A-9B illustrate an embodiment that uses at least two conductive coils, including a first conductive coil 509 and a second conductive coil 519, to actuate a beam 508. The two conductive coils 509 and 519 may be laterally disposed next to each other, i.e., side-by-side, such that a first end 508*a* of the beam 508 is disposed over the first conductive coil 509, and a second end 508*b* of the beam 508 is disposed over the second conductive coil 519. Each of first conductive coil 509 and the second conductive coil 519 may have a circular or elliptical shape. The first conductive coil 509 may be a coil of copper wire having a plurality of stacked turns that spiral along a central axis 520A of the first conductive coil, and the second conductive coil 519 may be a coil of copper wire having a plurality of stacked turns that spiral along a central axis 520B of the first conductive coil. The two central axes 520A and 520B may be parallel, and may be separated by a distance D. The two conductive coils 509, 519 may receive electrical current from the same power source 514, as shown in FIG. 9B, or may receive electrical current from respective different power sources. Like in FIGS. 8A-8B, a first coil portion 509*a* and a second coil portion 519*a* may be configured to generate respective magnetic field lines at its corresponding first end 508*a* or second end 508*b* of the beam 508. These magnetic field lines may interact with a first magnet 511 and a second magnet 512 at the first end 508*a* and the second end 508*b*, respectively. The interaction may produce rotational forces that rotate the beam 508 about an axial member 510.

In an embodiment, magnetic leakage may be reduced further by having the magnets of a beam in accordance with embodiments hereof, such as beams 208/308/408/508, extend in length from the two ends of the beam toward a center of the beam. For instance, a beam may be formed by attaching two flat bar magnets that have opposite magnetic poles, such that the whole of the beam is magnetized. The additional magnetized regions of the beam may provide additional interaction with magnetic field lines from a conductive coil, which may increase an amount of mechanical work that the beam can output. In other embodiments, however, the beam 208/308/408/508 may have a non-magnetized region made of, e.g., a polymeric material.

Figure 10:
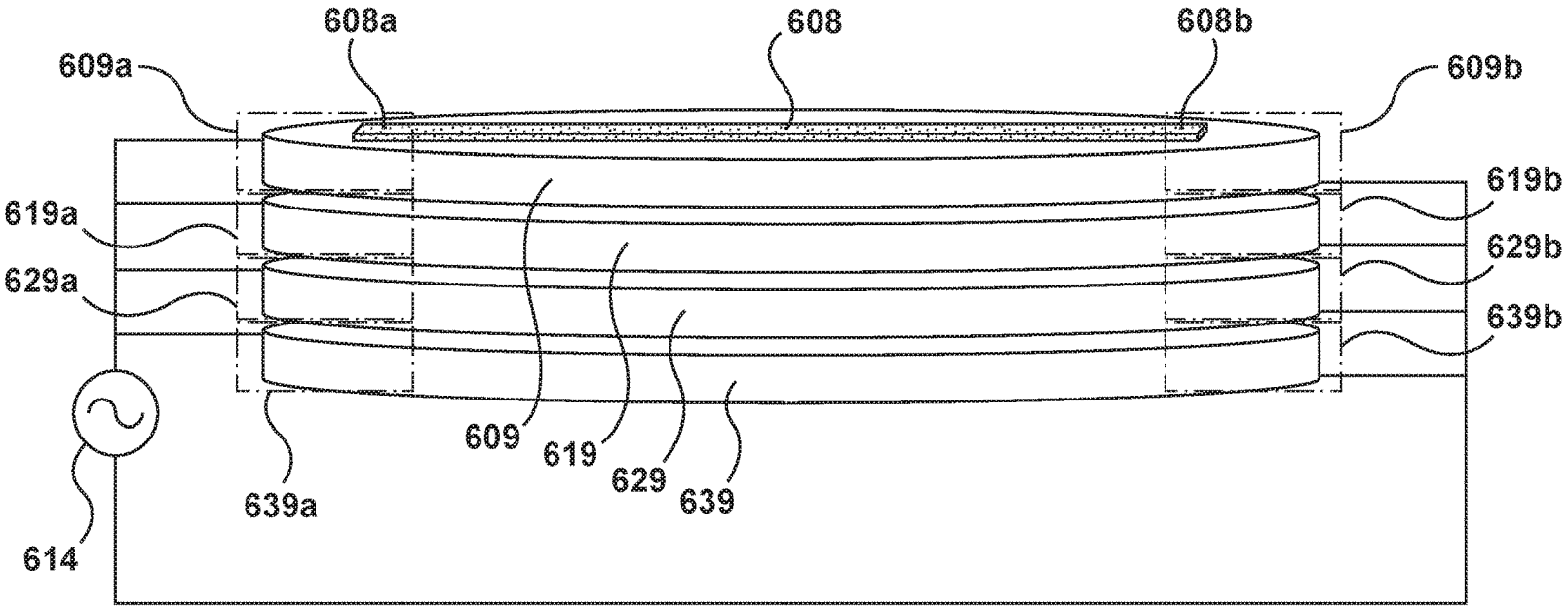
FIG. 10 depicts a plurality of conductive coils in a stacked configuration, according to an embodiment hereof.

In an embodiment, a power source may be connected to multiple conductive coils that are stacked on one another. For instance, while FIGS. 4A and 4B depict a single conductive coil 309 for generating magnetic field lines, FIG. 10 depicts a plurality of conductive coils which are stacked on one another, and electrically connected to a power source 614 in an electrically parallel configuration. For the single conductive coil 309 in FIGS. 4A-4B, the strength of its magnetic field may be increased by increasing a total number of turns that make up the coil 309. However, increasing the total number of turns of the conductive coil 309 also increases the electrical resistance of the coil 309, because the additional turns increase a total length of wire or other conductive material through which the electrical current has to travel. In other words, each additional turn of the conductive coil 309 may be electrically connected in series with a previous turn of the conductive coil 309, thus increasing a resistance of the coil 309 as a whole. The increased electrical resistance may increase power usage or the complexity of the power source 614. FIG. 10 depicts an arrangement in which four conductive coils are electrically connected in parallel, which may exhibit less electrical resistance to the power source 614. In FIG. 10, conductive coils 619, 629, and 639 may be added to conductive coil 609 to also increase a total number of turns used to generate magnetic field lines. However, conductive coil 619 is not electrically connected to a last turn of conductive coil 609, but is instead electrically connected to a positive terminal of the power source 614 (and to a negative terminal of the power source 614). This places the conductive coil 609 and the conductive coil 619 in a parallel arrangement which does not increase the electrical resistance to the power source 614, and may even further decrease the electrical resistance to the power source 614. The conductive coils 629 and 639 may be electrically connected to the power source 614 in a similar fashion so that all four conductive coils are placed in a parallel arrangement. Because each turn of the conductive coils may have an insulating coating, the four conductive coils may be electrically insulated from each other.

As shown in FIG. 10, the conductive coil 609 may be nominally segmented into at least a first coil portion 609*a* and a second coil portion 609*b*. The conductive coil 619 may be segmented into at least a third coil portion 619*a* and a fourth coil portion 619*b*. The other conductive coils may be segmented in a similar manner (into fifth coil portion 629*a*, sixth coil portion 629*b*, seventh coil portion 639*a*, eighth coil portion 639*b*). The first coil portion 609*a* may be stacked on the third coil portion 619*a*. They may be arranged in an electrically parallel configuration, as discussed above, and may each be configured to generate magnetic field lines at a first end 608*a* of a beam 608 that are parallel to a central axis of each of the coils. The second coil portion 609*b* may be stacked on the fourth coil portion 619*b*, and they may be arranged in an electrically parallel configuration, and may each be configured to generate magnetic field lines at a second end 608*b* of the beam 608 that are parallel to a central axis of each of the coils.

While FIG. 10 illustrates four conductive coils, more or fewer number of conductive coils (e.g., three coils, ten coils) may be used. In an embodiment, the stack of separate conductive coils in FIG. 10 may be combined with the arrangement in FIGS. 8A-8B and 9A-9B in which there are separate respective conductive coils at opposite ends of a beam. In this combination, a first coil portion may be a segment of a first conductive coil disposed at a first end of a beam. A second coil portion may be a segment of a second, separate conductive coil disposed at a second end of the beam. There may be a third coil portion that is a segment of a third conductive coil disposed at the first end of the beam and stacked beneath the first conductive coil. There may further be a fourth coil portion that is a segment of a separate fourth conductive coil disposed at the second end of the beam and stacked beneath the second conductive coil, and so on.

In an embodiment, manufacturing a haptic actuator (e.g., 204) may involve placing a conductive coil (e.g., conductive coil 209) on a base structure. In an embodiment, the conductive coil may be formed with a technique that wraps a copper wire or other conductive wire around an object or mandrel having an elliptical, circular, or C-shape, or any other shape. In another embodiment, the conductive coil may be formed with a technique that deposits alternating conductive layers and insulating layers to form the turns of the conductive coil, with techniques similar to those used in thin film technology. Both techniques may form a first coil portion at a first end of the base structure, and a second coil portion at a second and opposite end of the base structure, where each coil portion is configured to generate magnetic field lines.

Figure 11:
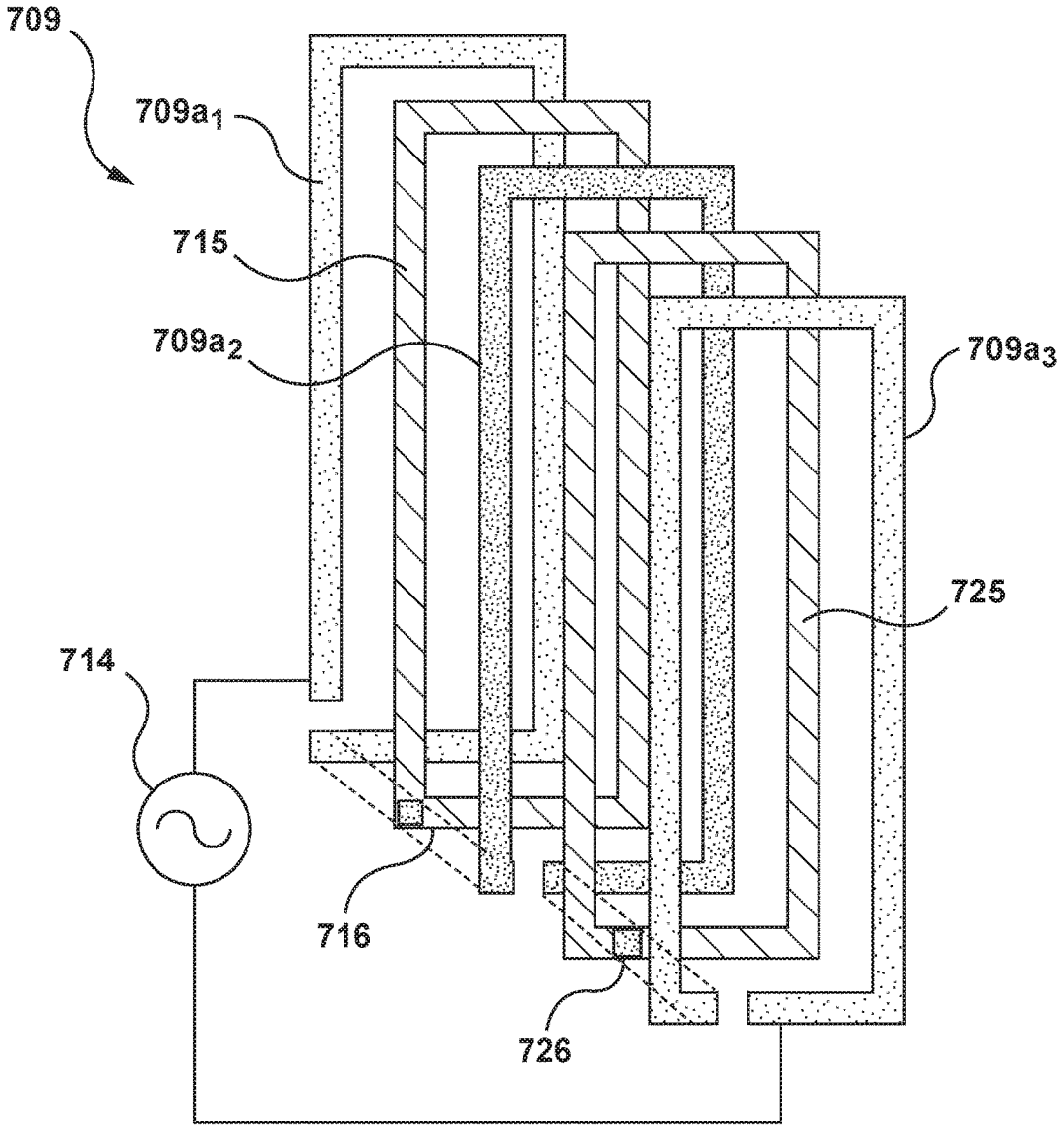
FIG. 11 depicts a conductive coil formed from a plurality of alternating conductive layers and insulating layers stacked on each other, according an embodiment hereof.

In an embodiment, the latter technique for forming the conductive coil may involve, e.g., a sputtering, a chemical vapor deposition (CVD), or other deposition process to deposit a stack of conductive layers to form a plurality of turns, and to deposit insulating layers between consecutive conductive layers. For example, FIG. 11 depicts a conductive coil 709 formed from such a technique. In FIG. 11, a first conductive layer 709$a_1$ (e.g., a conductive coating) may be deposited onto a base structure. In an embodiment, the base structure may have an opening like that shown in FIG. 3, and the first conductive layer 709$a_1$ (as well as subsequent layers) may be deposited in an elliptical or other loop shape around the opening. In an embodiment, the first conductive layer 709$a_1$ may be deposited as a uniform layer and patterned (e.g., using a lithography or etching process) into a conductive trace, to form a first turn of a conductive coil. As an example of the lithography process, a copper layer and a photoresist layer may be deposited on the base structure. The photoresist layer may be exposed to ultraviolet light and etched into a substantially loop shape, after which the copper layer is etched into the substantially loop shape. The photoresist layer may then be removed, leaving a substantially loop-shaped copper layer as conductive layer 709$a_1$. After the conductive layer 709$a_1$ is formed, an insulating layer 715 may be deposited on top of the first conductive layer 709$a_1$. In an embodiment, the insulating layers may be deposited or patterned to have an opening through which a beam can rotate. A second conductive layer 709$a_2$ may be deposited on top of the insulating layer 715 to form a second turn of the conductive coil. The first turn and the second turn of the coil may be electrically connected with a conductive via 716 that extends through the insulating layer 715. Additional insulating layers and conductive layers may be alternately deposited. For instance, another insulating layer 725 may be deposited on the second conductive layer 709$a_2$, after which a third conductive layer 709$a_3$ may be deposited on the insulating layer 725 to form a third turn of the conductive coil. The second turn and the third turn of the conductive coil may be electrically connected by a conductive via 726 which extends through the insulating layer 725. An advantage of the above deposition technique is that each conductive layer, corresponding to each turn of the conductive coil, may achieve a thickness as small as several microns (such as in a range between 1 micron to 50 micron, or even in the nanometer range), so that the conductive coil remains flat and/or has low visibility, thus enabling the manufacturing of miniaturized actuators.

After the conductive coil is formed in the manufacturing process, a beam or other moving element with magnetized ends may be attached to the base structure via an axial member. The magnetized ends may have been formed using permanent magnets or magnetic particles, the latter of which may use a mixing method involving a solution or use a melting technique.

While various embodiments have been described above, it should be understood that they have been presented only as illustrations and examples of the present invention, and not by way of limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the appended claims and their equivalents. It will also be understood that each feature of each embodiment discussed herein, and of each reference cited herein, can be used in combination with the features of any other embodiment. All patents and publications discussed herein are incorporated by reference herein in their entirety.

What is claimed is:

1. A haptic actuator, comprising:

a base structure;

a beam rotatably attached to the base structure by an axial member, the beam having a first end and a second end, wherein the first end includes a first magnet with magnetic poles having a first polarity, and wherein the second end includes a second magnet with magnetic poles having a second polarity opposite the first polarity;

a first coil portion attached to the base structure and disposed at the first end of the beam and configured to generate magnetic field lines at the first end of the beam when electrical current is passed through the first coil portion;

a second coil portion attached to the base structure and disposed at the second end of the beam and configured to generate magnetic field lines at the second end of the beam when electrical current is passed through the second coil portion, and wherein the first coil portion and the second coil portion are segments of a single conductive coil or are respective segments of separate first and second conductive coils, wherein the magnetic poles of the first magnet at the first end and the magnetic poles of the second magnet at the second end are aligned to be parallel with a central axis of the first coil portion or the second coil portion when the beam is in an equilibrium position corresponding to zero current being passed through the first coil portion and zero current being passed through the second coil portion, and wherein the beam is configured to rotate via the axial member relative to the first coil portion and the second coil portion in response to electrical current being passed through at least one coil portion of the first coil portion and the second coil portion.

2. The haptic actuator of claim 1, wherein the first coil portion and the second coil portion form opposite end segments of a single conductive coil that comprises a plurality of stacked turns of a conductive wire, the plurality of turns extending from a first turn to a last turn.

3. The haptic actuator of claim 2, wherein at least a portion of the beam is located within a space between the first coil portion and the second coil portion, and between the first turn and the last turn of the conductive coil.

4. The haptic actuator of claim 2, wherein the beam is disposed over a space defined by the first coil portion and the second coil portion, such that a gap exists between the beam and the conductive coil.

5. The haptic actuator of claim 1, wherein the first coil portion and the second coil portion are segments of separate first and second conductive coils, respectively.

6. The haptic actuator of claim 5, wherein the first conductive coil and the second conductive coil are disposed side-by-side such that the first end of the beam is disposed over the first conductive coil and the second end of the beam is disposed over the second conductive coil.

7. The haptic actuator of claim 6, wherein each of the first conductive coil and the second conductive coil has a circular or elliptical shape.

8. The haptic actuator of claim 5, wherein the first coil portion forms a concave portion relative to a remaining portion of the first conductive coil, and wherein the second coil portion forms a concave portion relative to a remaining portion of the second conductive coil.

9. The haptic actuator of claim 1, further comprising:

a third coil portion configured to generate magnetic field lines parallel to the central axis at the first end of the beam when electrical current is passed through the third coil portion, wherein the first coil portion is stacked on the third coil portion and arranged in an electrically parallel configuration with the third coil portion; and a fourth coil portion configured to generate magnetic field lines parallel to the central axis at the second end of the beam when electrical current is passed through the fourth coil portion, wherein the second coil portion is stacked on the fourth coil portion and arranged in an electrically parallel configuration with the fourth coil portion.

10. The haptic actuator of claim 9, wherein the first coil portion and the second coil portion are segments of a first conductive coil, and the third coil portion and the fourth coil portion are segments of a second conductive coil.

11. The haptic actuator of claim 9, wherein the first coil portion, the second coil portion, the third coil portion, and the fourth coil portion are segments of a first conductive coil, a second conductive coil, a third conductive coil, and a fourth conductive coil, respectively.

12. The haptic actuator of claim 1, wherein the first magnet is a first permanent magnet, and the second magnet is a second permanent magnet.

13. The haptic actuator of claim 12, wherein the beam comprises a non-magnetized region made of a polymeric material.

14. The haptic actuator of claim 1, wherein the axial member is attached to the base structure and attached at a rotational axis of the beam such that the beam is suspended thereby relative to the base structure.

15. The haptic actuator of claim 1, wherein the base structure has a surface facing the beam, the surface having an opening, and wherein the beam is suspended by the axial member over the opening and is configured to rotate to a position in which one end of the beam is coplanar with the opening or traverses the opening when electrical current is passed through the conductive coil.

16. The haptic actuator of claim 1, further comprising:

a control unit configured to pass an alternating current through the first coil portion and through the second coil portion in response to a determination to generate a tapping haptic effect.

17. The haptic actuator of claim 1, wherein a total coil thickness along the central axis is in a range from 5 mm to 10 mm.

18. The haptic actuator of claim 1, wherein the first coil portion and the second coil portion each comprise a stack of conductive layers separated by insulating layers, wherein each of the conductive layers has a thickness in a range between 1 micron and 5 microns, and wherein consecutive conductive layers of the plurality of conductive layers are electrically connected to each other with a conductive via located in an insulating layer disposed therebetween.

19. A method of manufacturing a haptic actuator, comprising:

providing a base structure;

forming a first coil portion at a first end of the base structure;

forming a second coil portion at a second end of the base structure, wherein the first coil portion is configured to generate magnetic field lines at the first end of the base structure when electrical current is passed through the first coil portion, wherein the second coil is configured to generate magnetic field lines at the second end of the base structure when electrical current is passed through the second coil portion;

attaching an axial member to the base structure;

attaching a beam to the axial member such that the beam is rotatable within the base structure, the beam having: (i) a first end that includes a first magnet with magnetic poles having a first polarity and (ii) a second end that includes a second magnet with magnetic poles having a second polarity opposite the first polarity, wherein the magnetic poles of the first magnet and the magnetic poles of the second magnet are aligned to be parallel to a central axis of at least one of the first coil portion and the second coil portion, and the beam is rotatable via the axial member relative to the first coil portion and the second coil portion.

20. The method of claim 19, wherein forming the first coil portion and the second coil portion comprises forming at least one conductive coil having a plurality of turns by using a sputtering process to deposit a stack of conductive layers to form the plurality of turns, wherein consecutive conductive layers of the plurality of conductive layers are separated by an insulating layer therebetween.

21. A haptic actuator, comprising:

a base structure;

a beam rotatably attached to the base structure by an axial member, the beam having a first end and a second end, wherein the first end includes a first magnet with magnetic poles having a first polarity, and wherein the second end includes a second magnet with magnetic poles having a second polarity opposite the first polarity, wherein the beam comprises a non-magnetized region made of a polymeric material, and wherein the first magnet is a first permanent magnet, and the second magnet is a second permanent magnet;

a first coil portion attached to the base structure and disposed at the first end of the beam and configured to generate magnetic field lines at the first end of the beam when electrical current is passed through the first coil portion;

a second coil portion attached to the base structure and disposed at the second end of the beam and configured to generate magnetic field lines at the second end of the beam when electrical current is passed through the second coil portion, wherein the first coil portion and the second coil portion form opposite end segments of a single conductive coil that comprises a plurality of stacked turns of a conductive wire, the plurality of turns extending from a first turn to a last turn, and wherein at least a portion of the beam is located within a space between the first coil portion and the second coil portion, and between the first turn and the last turn of the conductive coil;

a control unit configured to pass an alternating current through the first coil portion and through the second coil portion, wherein the magnetic poles of the first magnet at the first end and the magnetic poles of the second magnet at the second end are aligned to be parallel with a central axis of the first coil portion or the second coil portion when the beam is in an equilibrium position corresponding to zero current being passed through the first coil portion and zero current being passed through the second coil portion, and wherein the beam is configured to rotate via the axial member relative to the first coil portion and the second coil portion in response to electrical current being passed through at least one coil portion of the first coil portion and the second coil portion, wherein the base structure has a surface facing the beam, the surface having an opening, wherein the axial member is attached to the base structure and attached at a rotational axis of the beam such that the beam is suspended by the axial member over the opening and is configured to rotate to a position in which one end of the beam is coplanar with the opening or traverses the opening when electrical current is passed through the conductive coil, and wherein a total coil thickness along the central axis is in a range from 5 mm to 10 mm.

* * * * *